US011987989B2

(12) United States Patent
Shaw et al.

(10) Patent No.: US 11,987,989 B2
(45) Date of Patent: May 21, 2024

(54) CONCRETE WALL WITH DECORATIVE SURFACE AND METHOD OF FORMING SAME

(71) Applicant: Shaw Craftsmen Concrete, LLC, Costa Mesa, CA (US)

(72) Inventors: Ronald D. Shaw, Costa Mesa, CA (US); Jeff Counterman, Costa Mesa, CA (US)

(73) Assignee: Shaw Craftsmen Concrete, LLC, Costa Mesa, CA (US)

( * ) Notice: Subject to any disclaimer, the term of this patent is extended or adjusted under 35 U.S.C. 154(b) by 54 days.

(21) Appl. No.: 17/827,586

(22) Filed: May 27, 2022

(65) Prior Publication Data

US 2022/0290443 A1 Sep. 15, 2022

Related U.S. Application Data

(63) Continuation of application No. 16/883,511, filed on May 26, 2020, now abandoned.

(51) Int. Cl.

| | |
|---|---|
| ***E04B 2/86*** | (2006.01) |
| ***E04F 13/073*** | (2006.01) |
| ***E04F 13/08*** | (2006.01) |
| *E04F 13/14* | (2006.01) |

(52) U.S. Cl.

CPC ..... *E04F 13/0871* (2013.01); *E04B 2/8635* (2013.01); *E04F 13/0733* (2013.01); *E04B 2002/8676* (2013.01); *E04F 13/14* (2013.01)

(58) Field of Classification Search

CPC ... E04F 13/0871; E04F 13/0733; E04F 13/14; E04B 2/8635; E04B 2002/8676

See application file for complete search history.

(56) References Cited

U.S. PATENT DOCUMENTS

| | | | |
|---|---|---|---|
| 348,443 | A | 8/1886 | Anderson |
| 712,168 | A | 10/1902 | Worth |
| 738,704 | A | 9/1903 | Semmer |
| 745,068 | A | 11/1903 | Menczarski |

(Continued)

FOREIGN PATENT DOCUMENTS

| | | | | |
|---|---|---|---|---|
| WO | 8501690 | A1 | 4/1985 | |
| WO | WO-2017083415 | A1 * | 5/2017 | ..... B28B 11/001 |

OTHER PUBLICATIONS

Journal of the American Concrete Institute, "Cement-Aggregate Reaction in Concrete", Oct. 1947, vol. 19, No. 2, 36 pgs.

(Continued)

*Primary Examiner* — Patrick J Maestri

(74) *Attorney, Agent, or Firm* — Stetina Brunda Garred & Brucker

(57) ABSTRACT

A concrete wall has a back surface supported by a back panel while a decorative material is applied to an opposing front surface of the wall by hand or by pneumatic projection while the surface is still plastic, and without using bonding agents. The decorative material may be further exposed by a surface treatment before or after the front surface is floated and finished, with a sealant optionally applied thereafter. The front surface may be created by pneumatic methods or by pouring concrete into forms and removing the front panel to expose the front surface while it is still plastic but hydrated enough not to slump.

9 Claims, 7 Drawing Sheets

(56) References Cited

U.S. PATENT DOCUMENTS

| | | | |
|---|---|---|---|
| 763,064 | A | 6/1904 | Mercer |
| 821,277 | A | 5/1906 | Bellars |
| 828,031 | A | 8/1906 | Kemper |
| 830,747 | A | 9/1906 | Stauffer |
| 836,369 | A | 11/1906 | Dexter |
| 958,194 | A | 5/1910 | Thomas |
| 967,836 | A | 8/1910 | Rodham |
| 969,435 | A | 9/1910 | Adamson |
| 1,359,893 | A | 11/1920 | Hopkins |
| 1,397,678 | A | 11/1921 | De Paoli |
| 1,534,353 | A | 4/1925 | Besser |
| 1,728,936 | A | 9/1929 | Johnson |
| 1,769,990 | A | 7/1930 | Fischer |
| 1,891,530 | A | 12/1932 | Galassi |
| 1,939,007 | A | 12/1933 | Heltzel |
| 1,958,391 | A | 5/1934 | Hall et al. |
| 1,997,216 | A | 4/1935 | Heltzel |
| 2,101,540 | A | 12/1937 | Gullich |
| 2,172,629 | A | 9/1939 | Treuhaft |
| 2,200,433 | A | 5/1940 | Ripley |
| 2,275,272 | A | 3/1942 | Scripture, Jr. |
| 2,277,203 | A | 3/1942 | Boult |
| 2,296,453 | A | 9/1942 | Saffert |
| 2,476,465 | A | 7/1949 | Tarrant |
| 2,493,826 | A | 1/1950 | Oelfke et al. |
| 2,746,465 | A | 5/1956 | Farison |
| 2,907,129 | A | 10/1959 | Bedell |
| 2,925,831 | A | 2/1960 | Welty et al. |
| 2,931,751 | A | 4/1960 | Du Fresne |
| 2,949,828 | A | 8/1960 | Carnes |
| 3,157,097 | A | 11/1964 | Stinnett, Jr. et al. |
| 3,161,442 | A | 12/1964 | Reed |
| 3,319,392 | A | 5/1967 | Fitzgerald |
| 3,334,555 | A | 8/1967 | Nagin et al. |
| 3,368,464 | A | 2/1968 | Thorp, Jr. et al. |
| 3,441,457 | A | 4/1969 | Regnaud |
| 3,590,448 | A | 7/1971 | Bryant |
| 3,646,715 | A | 3/1972 | Pope |
| 3,797,867 | A | 3/1974 | Hartl |
| 3,798,868 | A | 3/1974 | Loranger |
| 3,815,824 | A | 6/1974 | Olson |
| 3,816,155 | A | 6/1974 | Iverson et al. |
| 3,838,930 | A | 10/1974 | Koch |
| 3,874,140 | A | 4/1975 | Seehusen |
| 3,967,911 | A | 7/1976 | Miers |
| 4,008,974 | A | 2/1977 | Miers |
| 4,070,849 | A | 1/1978 | Digiacomo |
| 4,076,875 | A | 2/1978 | Van Gasse |
| 4,115,976 | A | 9/1978 | Rohrer |
| 4,128,358 | A | 12/1978 | Compton |
| 4,146,599 | A | 3/1979 | Lanzetta |
| 4,190,997 | A | 3/1980 | Holt |
| 4,198,176 | A | 4/1980 | Bentz |
| 4,205,040 | A | 5/1980 | Aoyama et al. |
| 4,270,789 | A | 6/1981 | Cline |
| 4,281,496 | A | 8/1981 | Danielsson |
| 4,388,016 | A | 6/1983 | Levey |
| 4,443,496 | A | 4/1984 | Obitsu et al. |
| 4,496,504 | A | 1/1985 | Steenson et al. |
| 4,542,040 | A | 9/1985 | Nowak |
| 4,646,482 | A | 3/1987 | Chitjian |
| 4,662,972 | A | 5/1987 | Thompson |
| 4,697,951 | A | 10/1987 | Allen |
| 4,714,507 | A | 12/1987 | Ohgushi |
| 4,748,788 | A | 6/1988 | Shaw et al. |
| 4,769,201 | A | 9/1988 | Chiuminatta et al. |
| 4,889,455 | A | 12/1989 | Karlsson et al. |
| 4,915,888 | A | 4/1990 | Sato |
| 4,947,600 | A | 8/1990 | Porter |
| 5,010,982 | A | 4/1991 | Sedlmayr |
| 5,024,029 | A | 6/1991 | Abbott et al. |
| 5,042,211 | A | 8/1991 | Nestler |
| 5,092,091 | A | 3/1992 | Hull et al. |
| 5,114,475 | A | 5/1992 | Siegmund et al. |
| 5,125,953 | A | 6/1992 | Gattner et al. |
| 5,226,279 | A | 7/1993 | Rendon-Herrero |
| 5,234,128 | A | 8/1993 | Hill |
| 5,246,650 | A | 9/1993 | Clark |
| 5,395,673 | A | 3/1995 | Hunt |
| 5,441,677 | A | 8/1995 | Phillips, Sr. |
| 5,450,699 | A | 9/1995 | Lee |
| 5,494,729 | A | 2/1996 | Henry et al. |
| 5,645,664 | A | 7/1997 | Clyne |
| 5,673,489 | A | 10/1997 | Robell |
| 5,755,068 | A | 5/1998 | Ormiston |
| 5,794,401 | A | 8/1998 | Shaw et al. |
| 5,795,108 | A | 8/1998 | Lightle |
| 5,887,399 | A | 3/1999 | Shaw et al. |
| 5,888,017 | A | 3/1999 | Corrie |
| 5,910,087 | A | 6/1999 | Carter |
| 5,950,394 | A | 9/1999 | Shaw et al. |
| 5,956,912 | A | 9/1999 | Carter et al. |
| 5,975,985 | A | 11/1999 | Sutherland et al. |
| 6,016,635 | A | 1/2000 | Shaw et al. |
| 6,033,146 | A | 3/2000 | Shaw et al. |
| 6,082,074 | A | 7/2000 | Shaw et al. |
| 6,092,960 | A | 7/2000 | Mccallion |
| 6,112,487 | A | 9/2000 | Shaw et al. |
| 6,164,037 | A | 12/2000 | Passeno |
| 6,171,016 | B1 | 1/2001 | Pauls et al. |
| 6,238,277 | B1 | 5/2001 | Duncan et al. |
| 6,279,282 | B1 | 8/2001 | Krionidis |
| 6,330,774 | B1 | 12/2001 | Weinstein |
| 6,385,940 | B1 | 5/2002 | Maier et al. |
| 6,430,824 | B1 | 8/2002 | Smith |
| 6,444,077 | B1 | 9/2002 | Fennessy |
| 6,519,904 | B1 * | 2/2003 | Phillips ..... E04B 2/847 52/344 |
| 6,568,146 | B2 | 5/2003 | Harvey |
| 6,610,224 | B2 | 8/2003 | Sullivan |
| 6,739,805 | B2 | 5/2004 | Shotton |
| 6,779,945 | B2 | 8/2004 | Saffo |
| 6,780,369 | B1 | 8/2004 | Darrow et al. |
| 6,785,992 | B2 | 9/2004 | Chiarucci |
| 6,834,438 | B1 | 12/2004 | Heister |
| 6,955,834 | B2 | 10/2005 | Rohrbaugh et al. |
| 7,051,483 | B2 | 5/2006 | Bamford |
| 7,066,680 | B2 | 6/2006 | Wiley |
| 7,242,799 | B1 | 7/2007 | Bremsteller |
| 7,322,772 | B2 | 1/2008 | Shaw et al. |
| 7,334,962 | B1 | 2/2008 | Shaw et al. |
| 7,493,732 | B2 | 2/2009 | Brailsford et al. |
| 7,591,967 | B2 | 9/2009 | Palermo et al. |
| 7,607,859 | B2 | 10/2009 | Shaw et al. |
| 7,614,820 | B2 | 11/2009 | Shaw et al. |
| 7,670,081 | B2 | 3/2010 | Shaw et al. |
| 7,781,019 | B2 | 8/2010 | Shaw et al. |
| 8,079,775 | B2 | 12/2011 | Shaw et al. |
| D662,523 | S | 6/2012 | Goentzel |
| 8,936,411 | B1 | 1/2015 | Shaw |
| 8,962,087 | B2 | 2/2015 | Shaw et al. |
| 8,962,088 | B2 | 2/2015 | Shaw |
| 9,102,572 | B2 | 8/2015 | Shaw et al. |
| 9,487,951 | B2 * | 11/2016 | Shaw ..... E04B 2/845 |
| 9,579,764 | B1 | 2/2017 | Wetherell et al. |
| 9,580,915 | B2 | 2/2017 | Shaw |
| 9,695,602 | B2 | 7/2017 | Shaw |
| 9,790,693 | B2 | 10/2017 | Wilde |
| 10,648,183 | B2 | 5/2020 | Shaw |
| 2003/0007836 | A1 | 1/2003 | Clarke et al. |
| 2003/0061722 | A1 | 4/2003 | Bradley |
| 2003/0140594 | A1 | 7/2003 | Shaw et al. |
| 2003/0164753 | A1 | 9/2003 | Gongolas |
| 2003/0227814 | A1 | 12/2003 | Priesnitz et al. |
| 2004/0041295 | A1 | 3/2004 | Shaw et al. |
| 2004/0118025 | A1 | 6/2004 | Shalit |
| 2004/0197548 | A1 | 10/2004 | Kopystecki |
| 2004/0234693 | A1 | 11/2004 | Littleton |
| 2005/0140038 | A1 | 6/2005 | Frienser |
| 2005/0238429 | A1 | 10/2005 | Kipp |
| 2006/0083591 | A1 | 4/2006 | Shaw et al. |
| 2007/0187873 | A1 | 8/2007 | Bailey |
| 2010/0139196 | A1 | 6/2010 | Healy |
| 2012/0317912 | A1 | 12/2012 | Shaw |

(56) References Cited

U.S. PATENT DOCUMENTS

| | | | | |
|---|---|---|---|---|
| 2013/0125504 | A1 | 5/2013 | Brailsford et al. | |
| 2014/0000214 | A1 | 1/2014 | Vasquez, Jr. et al. | |
| 2014/0245694 | A1 | 9/2014 | Shaw | |
| 2014/0272147 | A1 | 9/2014 | Shaw | |
| 2015/0020475 | A1 | 1/2015 | Shaw | |
| 2016/0047121 | A1 | 2/2016 | Shaw | |
| 2017/0101745 | A1 | 4/2017 | Terstriep | |
| 2017/0275893 | A1 | 9/2017 | Shaw | |
| 2017/0298626 | A1* | 10/2017 | Shaw | C04B 41/53 |
| 2017/0334032 | A1 | 11/2017 | Yagur et al. | |
| 2019/0308342 | A1 | 10/2019 | Butler | |
| 2021/0000210 | A1 | 1/2021 | Lowe | |

OTHER PUBLICATIONS

Reed Publishing USA, "Speciality Concretes", Jun. 28, 1984, 6 pgs.
L.M. Schofiled Company, "Lithotex Top Surface Retarder", 1985, 1 pg.
Concrete Products, "Integral Color in Concrete", Apr. 1988, 5 pgs.
Ardex, Inc., "Self-Leveling Toppings and Underlayments", 4 pgs. (1992).
Concrete Construction, "Practical, Precise, and Profitable Concrete Production Systems", Aug. 1993, 1 pg.
Schwing America Inc., "Truck or Trailer Mounted Concrete Pump", 4 pgs. (1993).
www.cement.org, "Placing & Finishing Concrete", 4 pgs. (Dec. 13, 2003).
PNA Constructions Technologies; "PNA Square Dowel Basket Isometric"; 2 pgs. (Jun. 2004).
Sandell Manufacturing Co., Inc.; "Sandell's Zip Strip & Expansion Joint"; 2 pgs. (Oct. 2007).
Family Handyman, "How to Finish Concrete", Jul. 8, 2013 [http://www.familyhandyman.com/masonry/pouring-concrete/how-to-finish-concrete/view-all/].
Concrete Information, "Finishing Concrete Slabs, Exposed Aggregate, Patterns and Colors", 9 pgs.
Mayco Pump Corp., "ST-60 The ST Series of Mid Range Concrete Pumps", 4 pgs.
Quick Mix, "No One Beats the Price of the Quick Mix!", 1 pg.
Sinak Corporation, Product Information Sheet Sinak Sealers HLQ-125, HLQ-250 General Applications; 2 pgs.

* cited by examiner

CONCRETE WALL WITH DECORATIVE SURFACE AND METHOD OF FORMING SAME

CROSS-REFERENCE TO RELATED APPLICATIONS

The present application is a continuation of U.S. patent application Ser. No. 16/883,511, filed May 26, 2020, the entire disclosure of which is expressly incorporated herein by reference.

STATEMENT RE: FEDERALLY SPONSORED RESEARCH/DEVELOPMENT

Not Applicable

BACKGROUND

The present disclosure relates to a method and apparatus for use in concrete construction, and is more specifically directed to a concrete wall with a decorate surface thereon, and a method of forming the concrete wall and decorative surface.

Cast In Place (CIP) concrete walls are constructed by pouring un-hydrated concrete between two generally parallel concrete forms (e.g., front and back forms) that rest on or create a footing, with rebar and/or suitable wire mesh between the concrete forms. Puddling or vibration may be used to remove entrained air while the concrete is still week. After the concrete hydrates and hardens, the concrete forms are removed—usually the day after pouring at the earliest. Applying decorative surfaces to such concrete wall surfaces requires a bonding agent to hold or adhere the decorative material to the concrete. Such decorative surfaces are time consuming to apply because the bonding material requires special application and/or cleanup steps, and the bonding materials may inadequately stick to the concrete or to the decorative material as they are applied one or more days after the wall is created. There is thus a need for an improved way to apply a decorative material to a concrete wall.

U.S. Pat. No. 8,962,088 describes a concrete wall formed by applying shotcrete to an assembly having a back concrete form on a footing, with appropriate rebar or wire mesh held in place inside the forms as needed. A first concrete mixture with large and small aggregate is shotcrete or pneumatically applied to the form to create a concrete wall with a first concrete wall portion and then before the first concrete wall portion hardens, a second, face mixture of concrete is applied which has the large aggregates removed such that when the face mixture is pneumatically applied to the first surface, the face mixture defines a uniform surface which can be floated to form the final, exterior surface of interest. While this process results in a uniform exterior surface, it requires time and effort to separate out the larger aggregate and to create and apply the second concrete face mixture in a timely manner to ensure the face mixture sticks to the underlying, first shotcrete mixture. While the resulting wall surface is uniform and of improved appearance, it lacks a decorative surface formed by select sands, color, minerals, etc. There thus remains a need for an improved way to create a concrete wall with a decorative material on the exterior surface of the concrete wall, and an improved concrete wall with a decorative surface connected to that wall.

U.S. Pat. Nos. 7,781,819 and 9,102,572 describe a concrete wall poured between vertical concrete forms which are removed after the surface hardens or cures, typically at least one day after the wall is created. The hardened concrete surface is then roughened and a second concrete mixture applied to that roughened surface with the second mixture requiring separating out larger aggregate. This process is time consuming, labor intensive and requires multiple steps extending over several days, which requires repeated stops at the job site, increases costs, extends the cleanup time and creates bonding issues between the concrete wall and the second concrete mixture which are only partially addressed by the need to roughen the concrete wall surface. There thus remains a need for an improved way to create a concrete wall with a decorative material on the exterior surface of the concrete wall, and an improved concrete wall with a decorative surface connected to that wall.

U.S. Pat. Nos. 8,246,269 and 9,695,602 describe processes for forming an architectural concrete structure on a poured, horizontal concrete slab which has no concrete form on the upper, horizontal surface of the slab. These patents rely on the horizontal orientation to achieve their desired result and do not indicate any applicability to concrete walls which are formed by different processes using different concrete forms in different orientations to prevent slumping of the wet concrete. There thus remains a need for an improved way to create a concrete wall with a decorative material on the exterior surface of the concrete wall, and an improved concrete wall with a decorative surface connected to that wall.

BRIEF SUMMARY

A concrete wall has a back surface supported by a back panel while a decorative material is applied to an opposing front surface of the wall by hand or by pneumatic projection while that front surface is still plastic, the same day the wall is poured. No bonding agents are needed as the decorative materials are embedded into the plastic concrete surface. The decorative material may be further exposed by a surface treatment either before or after the front surface of the concrete wall is floated or cut or finished, with a sealant optionally applied thereafter. The concrete wall may be created by pneumatically applying a concrete mixture to fill a cavity in a concrete wall form (e.g., shotcrete), or by pouring concrete into wall forms having opposing front and back panels and then removing the front panel to expose at least the front surface while that front surface is still plastic. Optionally, the back panel may be removed while the back surface is still plastic and the decorative material may also be applied to that back surface while it is still plastic.

The method of forming the decorative surface on the concrete wall generally includes forming an underlying concrete wall using a single mixture of concrete and then applying a concrete decorative material to the exterior face of the concrete wall while it is still in a plastic or non-hydrated state. This allows for the decorative material to be applied without polymers or bonding chemicals to fasten the decorative material to the concrete wall, which drastically reduces labor and material costs. The decorative material is applied when the exterior surface of the concrete wall is still plastic but the underlying concrete wall may be sufficiently self-supporting that the exposed front surface does not slump. Thus, the hardening time for the concrete surface in which the decorative material is embedded is further reduced or eliminated, which additionally helps with project scheduling and sequencing. The decorative material is formed of smaller aggregates such that the decorative material may advantageously define a uniform texture and appearance.

There is thus advantageously provided a concrete wall with a decorative surface and a method of forming that decorative surface on the wall. The method includes forming a decorative surface on a concrete wall in a concrete form having two opposing end panels, a bottom panel and a back panel extending between the end panels to define a wall cavity. The wall cavity contains wall rebar and may contain foundation rebar. The method includes the step of projecting a concrete mixture into the wall cavity sufficient to create a concrete wall entraining the wall rebar and any foundation rebar. The concrete wall has two opposing end surfaces each adjoining a different one of the end panels, along with a back wall surface adjoining the back panel and an exposed front wall surface opposite the back panel. The method includes floating and/or cutting the exposed front wall surface to achieve at least one of a desired wall thickness or wall contour. The method also includes applying a decorative material to the exposed front wall surface while that front wall surface is still plastic.

In further variations, the above method optionally includes one or more further steps. These further steps may include finishing the front wall surface and/or applying a surface treatment to the decorative material to further expose small particles of the decorative material embedded in the front wall surface. The method may also include a concrete form having a bottom panel that comprises a concrete foundation and may further include a preliminary step of placing foundation rebar in a foundation cavity, with the foundation rebar extending into the wall cavity and then having the projecting step additionally project the concrete mixture into the foundation cavity to create the concrete foundation and concrete wall at the same time. Additionally, the method may include a bottom panel that includes a hardened concrete foundation and that includes the preliminary step of creating that concrete foundation and allowing it to hydrate for at least one day before applying the concrete mixture to the wall cavity. Each of these method variations, and the other variations summarized herein, are believed to result in improved concrete walls with variations in the wall and/or its decorative surface.

The method may include the further steps of applying an acid cleaner to the decorative material and then applying a sealant to the decorative material. The step of applying the surface treatment may include sandblasting, grinding, honing, chemical etching, sponging or applying a retarder and later washing some of the retarder off, or combinations thereof.

The concrete wall is preferably substantially vertical, but may be inclined relative to the vertical direction. The decorative materials may be applied by hand, including by floating or troweling, or they may be applied by projecting the decorative materials against the front surface of the concrete wall with sufficient force to embed the decorative materials into that front surface, as for example, by using mechanical or pneumatic projection devices. The decorative material 36 may comprise small particles having a mean size larger than a 1/64 of an inch such as small aggregate and shells, or it may include color or minerals or combinations of these (and other) decorative materials.

There is also provided a method of forming a concrete wall in a poured concrete form having two opposing end panels, a bottom panel and opposing front and back panels extending between the end panels to define a wall cavity. The wall cavity may contain wall rebar and may optionally contain foundation rebar. The method includes the steps of applying a wet concrete mixture to the wall cavity to create a concrete wall entraining the wall rebar, usually by pouring the mixture into the wall cavity until the form is full and then leveling off the top of the wet concrete parallel to the top of the side panels of the concrete form. The concrete wall has two opposing ends each adjoining a different one of the end panels, a top and opposing front and back surfaces adjoining the respective front and back panels. The method includes the further step of removing the front panel and applying a decorative material to the front surface of the concrete wall while that front wall surface is still plastic. Advantageously, the front panel is not removed until after the front wall surface has hydrated sufficiently that the concrete wall does not slump, and preferably does not slump sufficiently to increase a thickness of the concrete wall at the bottom panel by more than 5%.

In further variations, this method may include the steps of floating and/or finishing the front wall surface containing the decorative material. The method may also include the further step of applying a surface treatment to the front wall surface containing the decorative material to further expose small particles of the decorative material embedded in the front wall surface.

Additionally, the method may include the further steps of removing the back panel to expose a back surface of the concrete wall adjoining the back panel and removing that back panel while that back wall surface is still plastic and then applying a decorative material to the back surface of the concrete wall while that back wall surface is still plastic. Advantageously the back panel is removed after the concrete mix has hydrated sufficiently that the concrete wall retains its shape and preferably removed after the concrete mix has hydrated sufficiently so that the concrete wall does not slump sufficiently to increase the thickness of the concrete wall at the bottom panel by more than 5% compared to the thickness when the front panel is removed. The method may also include the further step of floating and finishing the portion of the back wall surface containing the decorative material, and/or sealing that decorative material on that back wall surface.

The step of applying the surface treatment comprises one of sandblasting, grinding, or honing, chemical etching, sponging or applying a retarder and later washing some of the retarder off. Advantageously, the concrete wall is substantially vertical, but it may be inclined, but advantageously not inclined more than 60 degrees from the vertical. The method may include the steps of applying the decorative materials by hand, or projecting the decorative materials against the selected plastic surface of the concrete wall with sufficient force to embed the decorative materials into the selected surface.

Advantageously, the concrete wall with decorative materials on the front surface is formed by one or more of the above described combinations of steps. Further, the concrete wall may be formed with the decorative materials on both the front and back surface as formed by one or more of the above described combinations of steps.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

As used herein, the following part numbers refer to the following parts throughout: 10 & 10'—concrete forms; 12—back panel; 14— end panel; 16—end panel; 18 & 18'—cavity; 20— bottom panel; 21— top panel; 22— brace; 24—wall rebar; 25—foundation rebar; 26— spacers; 28— protective floor panel; 30— concrete mixture; 31—hose; 32—exposed surface as shot; 34— floated surface; 36— decorative material; 38 & 38'— finished decorative surface; 42—front panel; 44— second brace; 46— exposed plastic concrete surface; 52— float concrete; 54— apply decorative materials; 56— final float/finish; 58— expose decorative materials; 60— frame/pour foundation; 62— provide concrete form; 64— add reinforcing materials to form; 66. —install wire gauges for depth; 68— frame or create foundation; 69—assemble forms; 70— pour concrete in forms; 72— strip forms; 73— float exposed surface; 74— apply decorative materials; 76— float & finish wall; 78— expose decorative materials; 80— applying sealant; 90— trench; 92— trench cavity; 94— top foundation panel The detailed description set forth below is intended as a description of the presently preferred embodiment of the invention, and is not intended to represent the only form in which the present invention may be constructed or utilized. The description sets forth the functions and sequences of steps for constructing and operating the invention. It is to be understood, however, that the same or equivalent functions and sequences may be accomplished by different embodiments and that they are also intended to be encompassed within the scope of the invention.

Figure 1:
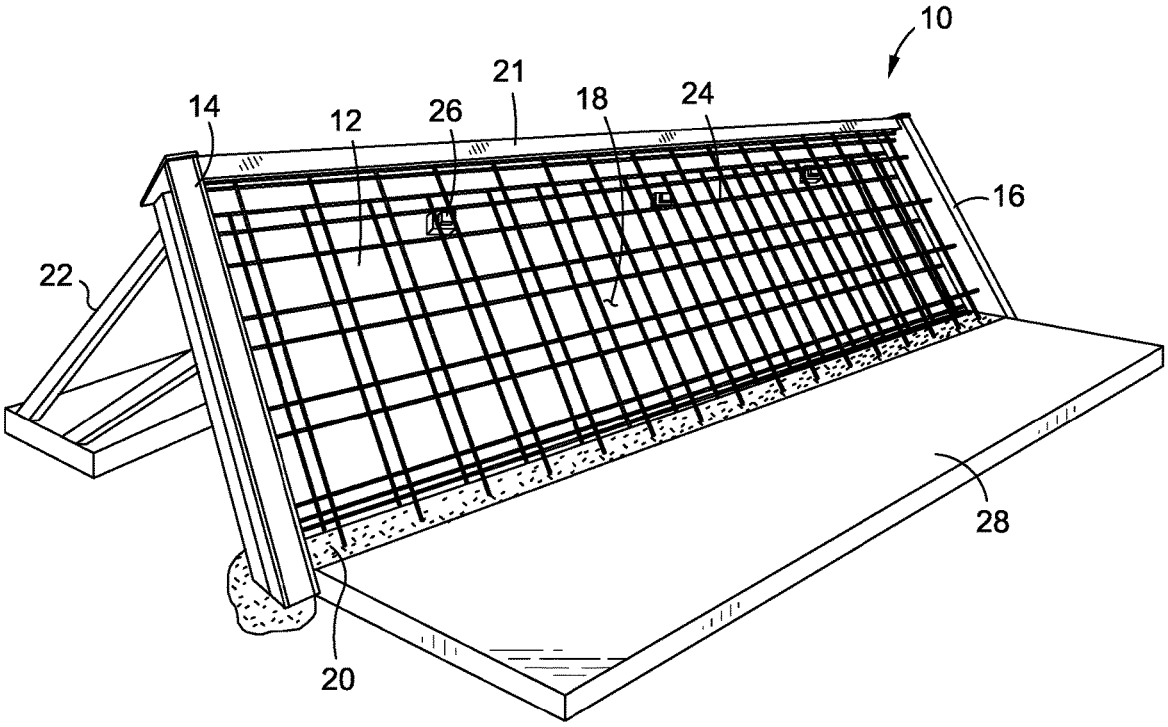
FIG. 1 is a perspective view of a wall form that is used to construct a concrete wall with the form having one exposed side for applying the concrete mixture to that exposed side which is initially referred to herein as the "front" side.
Figure 2:
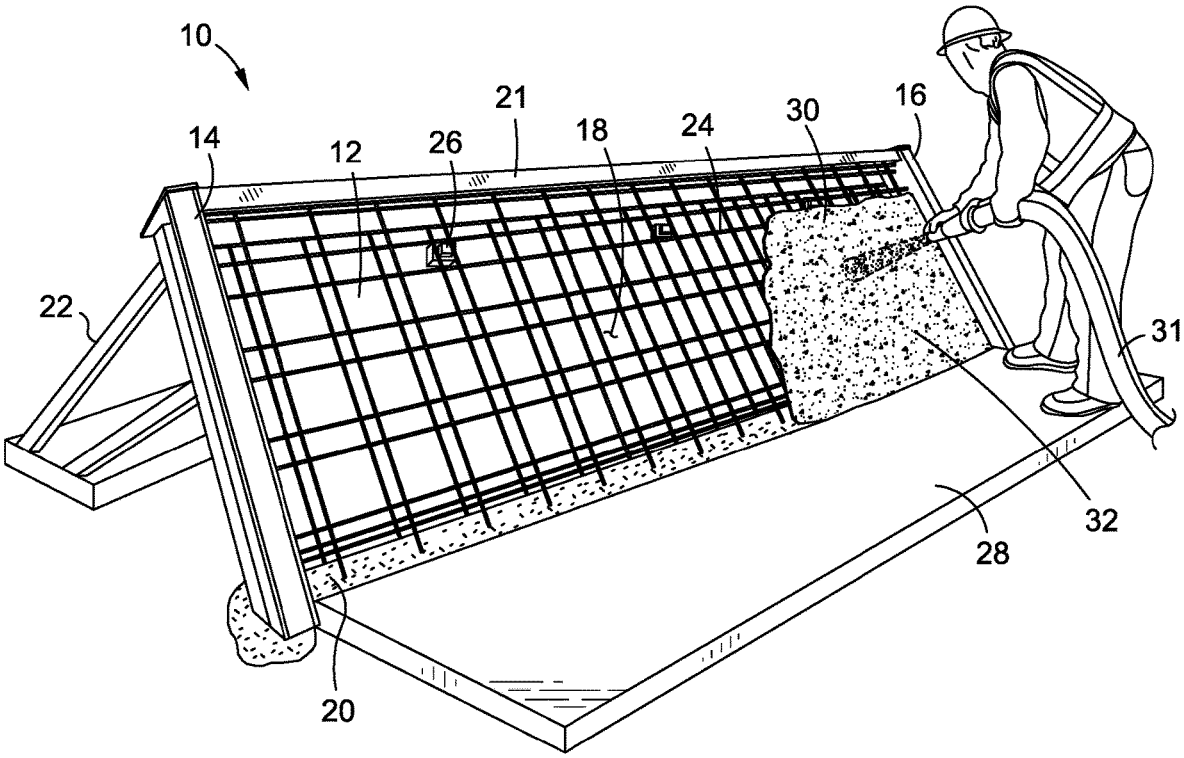
FIG. 2 is a perspective view of a concrete mixture being projected into the wall form of FIG. 1.

Referring to FIGS. 1-2, a concrete wall form 10 may be used for constructing a concrete wall. The illustrative wall form 10 includes a back panel 12 and a pair of opposed end panels 14, 16 disposed on opposite ends of the back panel 12. The back panel 12 and end panels 14, 16 collectively define three sides of a box-like wall cavity 18 within which concrete may be disposed to form a portion of a concrete wall. The end panels 14, 16 are advantageously perpendicular to the back panel 12 to form a square edge, but could be inclined thereto to form an inclined edge. The side panels are preferably planar and parallel to each other, but need not be so.

The wall form 10 is advantageously positioned over a bottom panel 20 which is typically a floor or shaped foundation that extends between the opposing end panels, 14, 16 and is the bottom side (or foundation) upon which the concrete wall may be constructed. As used herein, references to the bottom panel 20 will include both a foundation and a floor, as either the foundation or floor can function as a bottom panel for the concrete wall. For convenience, the description will usually refer to the bottom panel 20 as a foundation as that is the more common construction.

A top panel 21 may optionally be provided which extends between the side panels 14, 16 and is opposite the foundation 20 defining the top edge of the wall. Optionally, but less preferably, the foundation 20 may comprise both a foundation cavity and wall cavity having a combined shape defined by forms so the concrete wall and foundation may be created at the same time, in a single, substantially continuous pour of wet concrete or projection of pneumatically applied concrete as described later regarding FIG. 12C. The back panel 12, opposing end panels 14, 16, and opposing bottom and top panels 20, 21 form five sides of a box-like wall cavity 18 within which concrete may be disposed to form at least a portion of a concrete wall. The facing surfaces of the end panels 14 and 16 are typically parallel to each other, as are the facing surfaces of the bottom and top panels 20, 21, but need not be so. The panels 14, 16, 20, 21 typically form a rectangular wall cavity 18, but other shapes are possible as the concrete form 10 is illustrative. The wall form 10 depicted in the Figures is used to create a concrete wall having a generally rectangular cross-section and rectangular peripheral shape. It is understood that the methodologies described herein may be used with wall forms 10 that define other shapes and sizes, including curved surfaces.

The location and orientation of the wall form 10 may correspond to the desired position and orientation of the hardened concrete wall. In FIGS. 1 and 2, the wall form 10 is supported by a brace 22 to maintain the wall form 10 at an angled orientation relative to a vertical plane. The wall form 10 may be arranged at various angles relative to the ground but is typically arranged at a 90° angle to the ground to create a vertical concrete wall. Even with a vertical orientation of the wall form 10, the brace 22 is commonly used as it provides lateral support to the wall form 10 so as to maintain the wall form 10 in its upright configuration when concrete is projected thereon, as will be described in more detail below. Additionally, the wet concrete is heavy and not self-supporting until it hydrates and hardens sufficiently, so the brace 22 and wall form 10 maintain the shape of the back side and edges of the concrete wall during formation and curing of the concrete without unacceptable deformation from the weight of the concrete.

Internal support members, such as wall rebar 24 (which includes reinforcing wire) may be positioned within the wall cavity 18 so as to become encapsulated by the concrete as it is projected into the wall cavity 18 to provide internal support to the concrete wall and to better control potential cracking. The wall rebar 24 may be arranged to define a lattice framework to provide support along at least two axes, generally the horizontal and vertical axes. Furthermore, the wall rebar 24 may be positioned within two separated planes and may be spaced from the back wall 12 using spacers 26 to position the wall rebar 24 in spaced relation to each other. Each separated plane of wall rebar 24 is typically parallel to the back panel 12 when the concrete wall has generally parallel, opposing surfaces.

Although the Figures depict wall rebar 24 disposed within the wall cavity 18, it is understood that other items may be placed within the wall cavity 18 before concrete is projected therein. For instance, wire gauges may be installed to allow installers to determine the depth or thickness of the concrete projected into the wall cavity 18. Furthermore, electrical lines may be placed within the wall cavity 18 if the concrete wall includes lights or electrical outlet. Drainage lines or other plumbing lines may additionally be included as needed. Pass through fittings for various conduits and pipes may likewise be provided before the concrete is applied to the concrete form 10.

As best seen in FIG. 2, an optional, protective floor panel 28 may be connected to or placed adjacent to the wall form 10 to provide a flat, preferably horizontal surface for a worker to stand on when filling the wall cavity 18 with concrete. And working on the wall2. The protective floor panel 28 advantageously extends between the pair of opposing end panels 14, 16 and has an inner edge that is parallel to a lower edge of the back panel 12. Advantageously, the inner edge of the protective floor panel 28 provides a visual and physical guide for the thickness of the concrete wall along the length of the panel 28.

FIG. 2 shows the wall cavity 18 of the wall form 10 being filled with a concrete mixture 30 by a shotcrete-type projection process that projects wet concrete mixture 30 at a high velocity into the wall cavity 18 to create a body of wet, compacted concrete in the wall cavity 18. The wet concrete is pumped or otherwise forced through a hose 32 from a holding tank into the wall cavity 18. The concrete mixture 30 may include gunite and other concrete mixtures known by those skilled in the art that are suitable for high pressure spray applications, suitable for pneumatic application through a hose 31 to form vertical walls, or other concrete mixtures suitable for walls which allow use of the methods described herein. The concrete mixture 30 preferably includes a combination of small and large aggregate. This concrete mixture 30 may form part of an exposed surface of the concrete wall. The concrete mixture 30 is projected into the wall cavity 18 until the wall cavity 18 is filled sufficiently to form a concrete wall of the desired thickness or slightly less than the desired thickness and having an exposed wall surface 32 that is usually generally planar but non-uniform because of the impact used to create the concrete wall surface.

Figure 3:
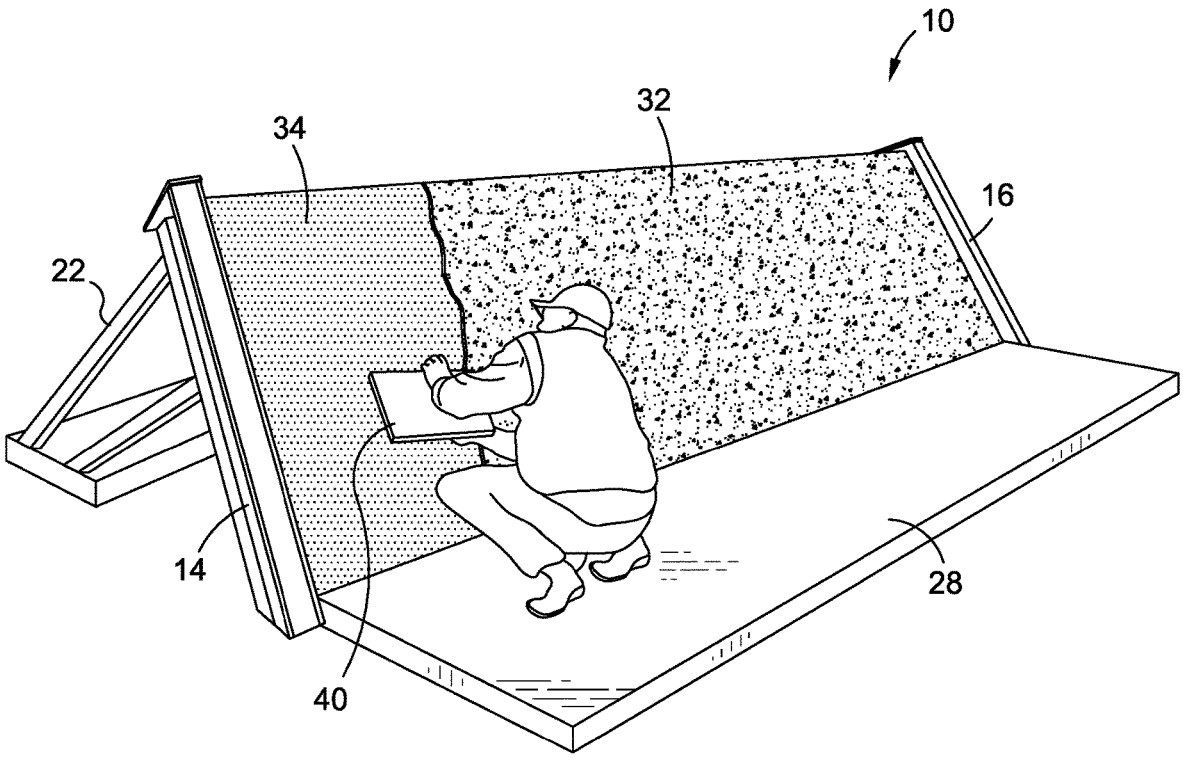
FIG. 3 is a perspective view of a worker floating and/or cutting the exterior surface of the concrete wall within the wall form.

Referring to FIG. 3, while the concrete wall surface 32 is still in a non-hydrated, plastic state, the wall surface is preferably floated or cut, typically using a bull float or trowel 40 or straight edge and guides to cut and/or float the surface to create a floated wall surface 34 that is smoother than the as-shot wall surface and that has the specified wall thickness and/or contour. The top panel 21 may be removed before the floating or left in place until later and may serve as a thickness and/or contour guide. If no top panel 21 is present then the top edge of the concrete wall is usually floated to create a top edge that is flat or has the desired shape with whatever texture is deemed appropriate.

The compacting of the concrete mixture 30 from being projected against the back panel 12 helps set the concrete and reduce slumping. As used herein, slumping of a concrete wall formed by projecting concrete occurs when the thickness of the concrete wall at the bottom panel 20 increases by 5% or more after the exposed front surface 32 is first floated or cut to create surface 34.

Figure 4:
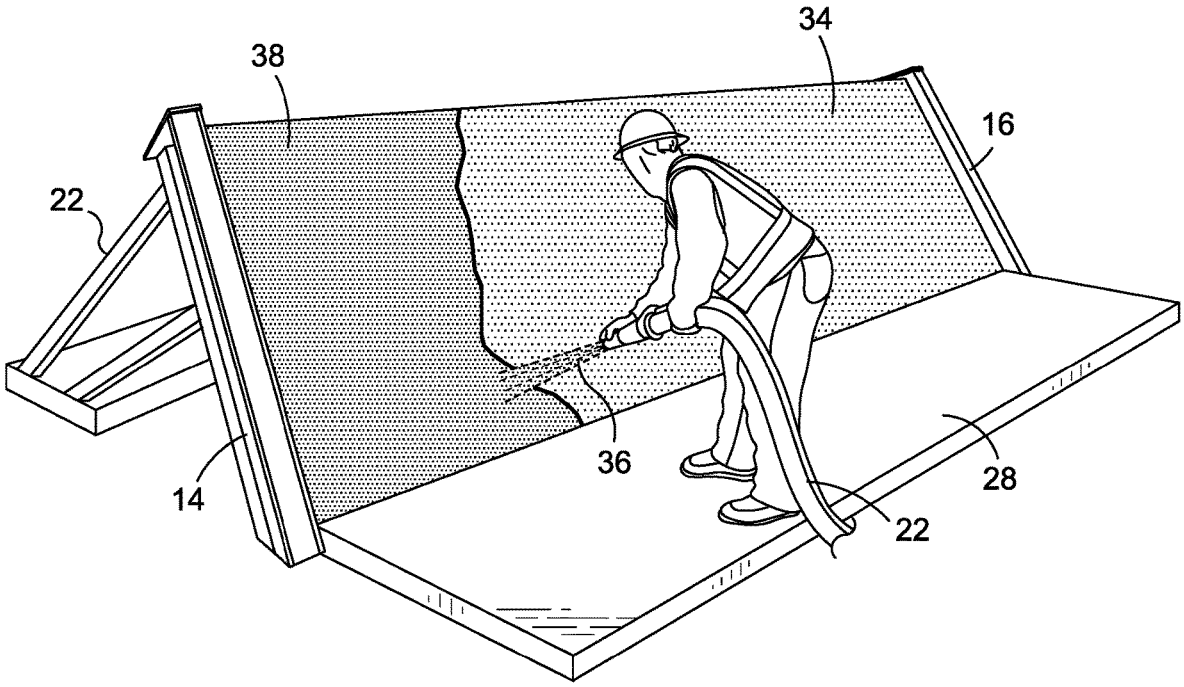
FIG. 4 is a perspective view of a decorative material being applied to the concrete in the wall form of FIG. 3 by projection.
Figure 5:
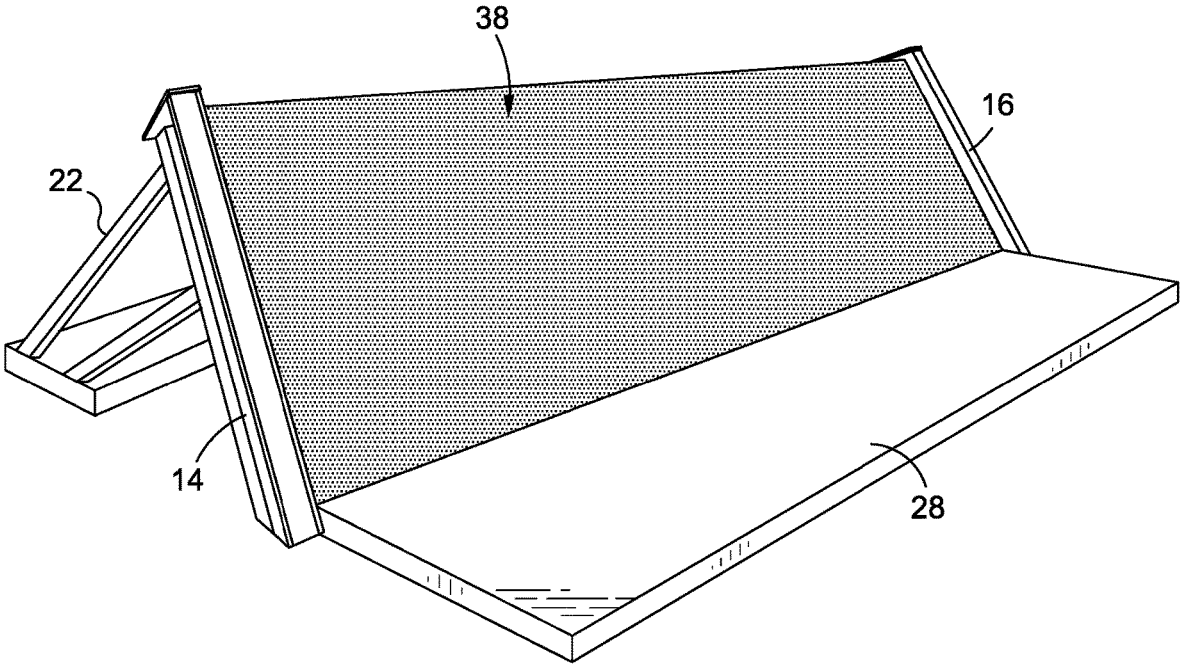
FIG. 5 a perspective view of a decorative material being floated into the plastic, exterior surface of the concrete wall.
Figure 6:
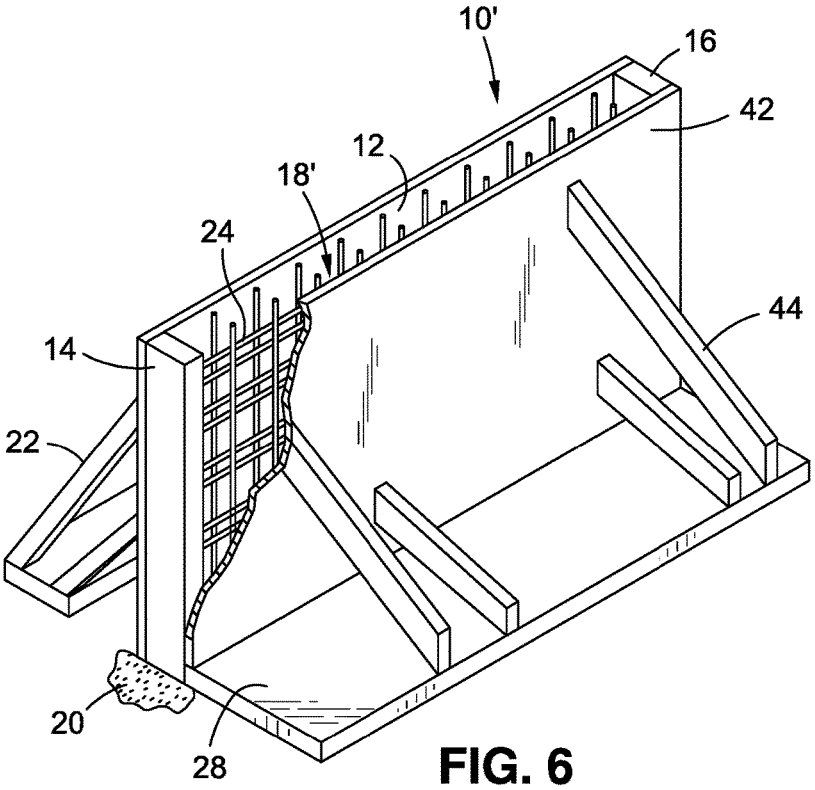
FIG. 6 is a perspective view of a poured wall form used to construct a poured concrete wall with the form having two opposing side panels for the opposing sides of the concrete wall.
Figure 7:
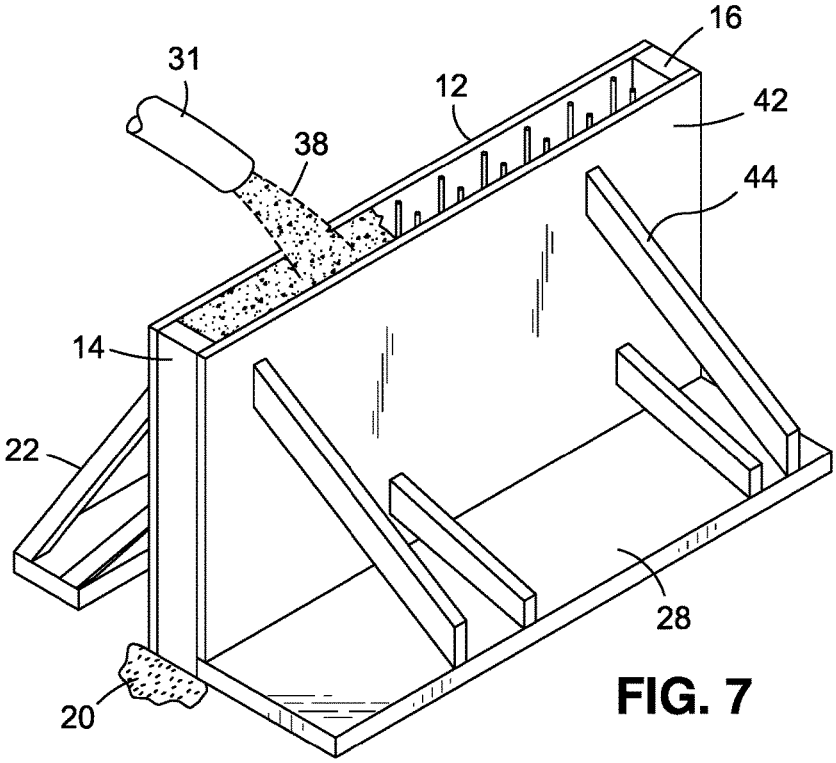
FIG. 7 is a perspective view of a concrete mixture filling the wall cavity created by the poured concrete form of FIG. 6.

Referring to FIG. 4, while the cut and/or floated wall surface 34 is still in a non-hydrated, plastic state a concrete decorative material 36 is forced into the plastic exterior of the floated wall surface 34 or alternatively, forced into the as-shot concrete wall surface 32. The decorative material 36 may optionally be applied to the top edge of the wall as well as to the floated wall surface 34 or the un-floated wall surface 32. If present, the top panel 21 would be removed before applying decorative material 36 to the top ledge of the wall.

The decorative material 36 may comprise select sands, colored sands, color, colored concrete, colored cement minerals, shells, stones, pebbles, glass fragments, brick fragments, cement and other small materials, aggregate or combinations thereof, to define the desired appearance. The decorative material 36 preferably has only small sized particles contained therein by which is meant particles having a mean diameter of less than three-eighths of one inch.

The decorative material 36 is advantageously applied in a manner that forces the decorative material 36 into the plastic exterior wall surface 32, 34 of the non-hydrated concrete and preferably forces the mixture 36 a sufficient distance into that exterior wall surface so that a majority of any aggregate and sand in the decorative material have a majority and preferably more than a majority, of the surface of each particle (e.g., aggregate, sand, shell) entrained in that exterior wall surface so as to securely embed any particulates in the decorative material 36 into the plastic concrete wall surface 32, 34 to form a finished concrete wall surface 38. For decorative materials 36 (including colors) which contain no particulates that are even the size of fine sand (1/64 inch mean diameter), the decorative material is applied so that it either wicks into or is forced into the plastic concrete wall surface 32, 34 to a depth of at least half the mean size of the decorative material over a majority of the surface area to which the decorative material is applied. Advantageously, if the decorative material 36 comprises color or other decorative material that is a liquid having no discrete physical particles detectible by rubbing the liquid between a person's fingers, the liquid penetrates to a depth of at least 0.1 inches, and as used herein, such a liquid is considered to penetrate plastic concrete surface a distance of at least half the mean size of the decorative material.

The objective of the particle entrainment (including color penetration) is to hold the materials and particles in the decorative material 36 to the concrete wall surface for considerable lengths of time amounting to at least five years. The decorative material 36 may be applied by a pneumatic process with or without floating to smooth and shape the wall surface 32, 34. The decorative material 36 may also be applied by hand as by floating the material 36 into the plastic concrete surface. The decorative material may further be broadcast onto the plastic concrete wall surface 32, 34 or applied by hand, as for example, by using brushes, by rollers, by hand implements such as floats or trowels, or by other mechanisms.

The finished concrete wall surface 38 comprises the concrete wall with the decorative material 36 applied to the plastic, exposed surface 32, 34 by any of the described steps without further finishing steps. Advantageously though, the finished concrete wall surface 38 is further floated to further embed the decorative material 36 and is further finished by surface troweling to draw the cement toward the exposed surface while further embedding the decorative material in the wall.

As desired, the finished concrete wall surface 38 may be further enhanced by applying a surface treatment, such as surface retarder, sandblasting, acid etching or sponging or other methods that further expose any small particles in the surface materials that are embedded in the front surface of the concrete, including small particles such as aggregate, shells, sand or other small particles. The surface retarder is applied before the concrete is fully hydrated and is optionally masked or covered by a vapor barrier to allow the body of the concrete wall to hydrate or harden, while allowing the wall surface penetrated by the retarder to hydrate or harden at a slower rate so that a portion of the retarder and concrete may be washed off to further expose the outer portion of the decorative material 36 embedded in or penetrated into the finished concrete wall surface 38. Sandblasting is typically applied to green concrete or hydrated concrete and uses abrasive particles applied pneumatically to remove an outer layer of the finished wall surface 38 to further expose the decorative material 36 such as aggregate or other particulates embedded in the finished concrete wall surface 38. High pressure water may be used similar to sandblasting to expose more of the decorative material 36. Acid etching is typically applied to green concrete or hydrated concrete and uses a weak acid solution, applied by spraying or by sponges using rubber gloves to expose the decorative material 36 such as aggregate or other particulates embedded in the finished concrete wall surface 38. Sponging is usually applied to concrete that is still plastic and uses water and sponges to hand wash away the outer layer of cement and expose the particulates of the decorative materials 36 embedded in the finished concrete wall surface 38.

After the concrete wall is hydrated sufficiently that the concrete form 10 can be removed without altering the shape or surface of the hardened concrete wall, the concrete form 10 is removed. The decorative materials 36 on the finished concrete wall surface 38 may be sealed by applying a sealant, typically a polymer. The application of the sealant may be preceded by an acid wash, preferably after the concrete is no longer plastic enough to embed the decorative material 36.

Figure 11:
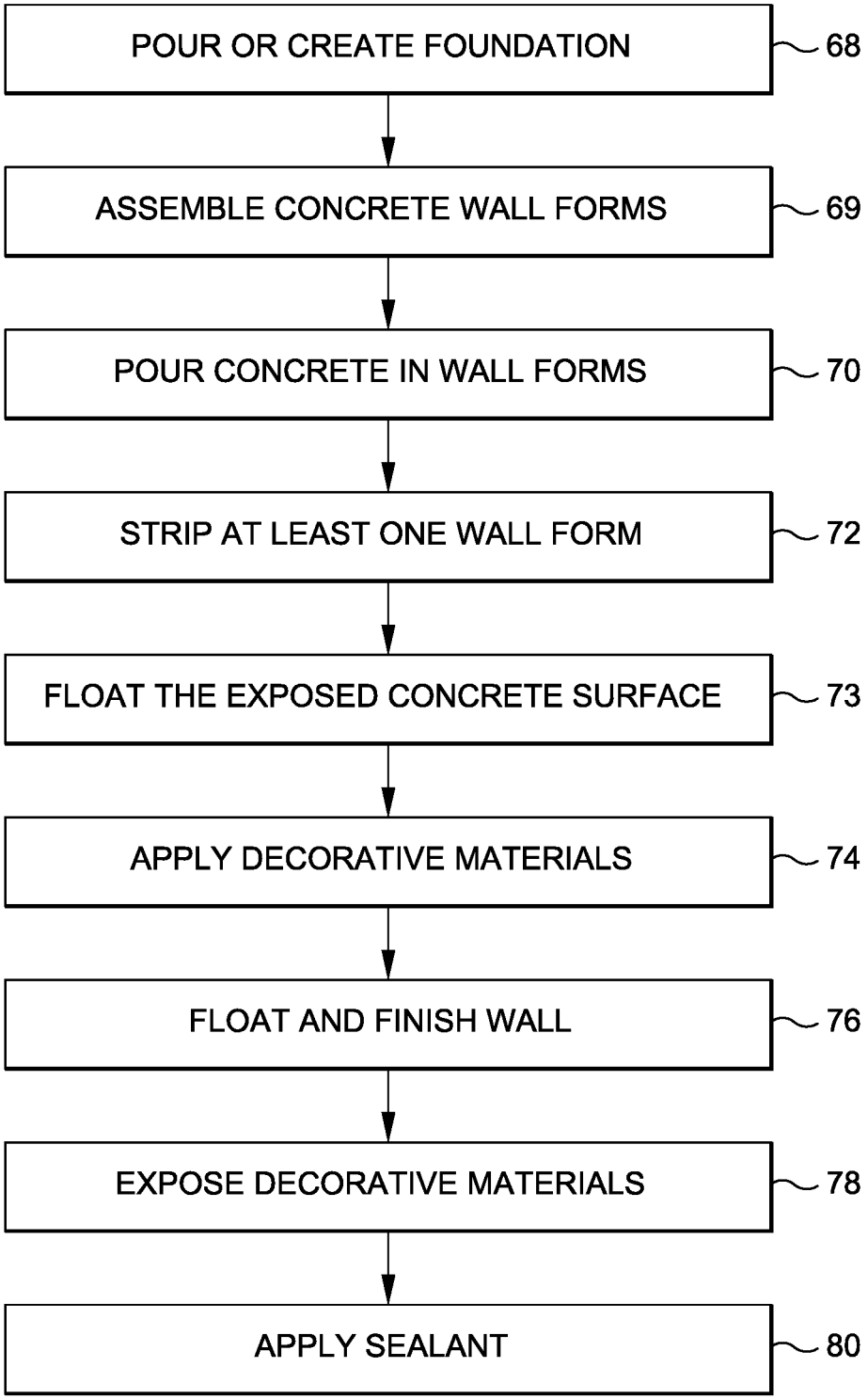
FIG. 11 is a flow diagram of several method steps for applying decorative material to a plastic concrete surface to create a decorative surface on the concrete wall.

Referring to FIG. 11, the various steps of the method of producing the decorative concrete wall may include projecting shotcrete concrete or gunite or a non-hydrated concrete mixture into a wall cavity 18 of concrete form 10 to form a wall as in step 50. The concrete wall may be cut and/or floated to a desired thickness and contour as in step 52. The decorative coating 36 may be applied to visible portions of the wall while the wall is still sufficiently plastic to embed the decorative coating or allow wicking or color penetration to the above described depth as in step 54. An optional final float/finish step may be applied to the decorative coating 36 on the concrete wall as in step 56. An optional enhancing step may further expose any particles in the decorative material 36 embedded in the concrete wall as in step 58.

The method may include one or more of the preliminary steps of framing and pouring the foundation 20, before or concurrently with projecting concrete to form the wall as in step 60. The framing may include forming trenches in the ground that define a wall of the resulting concrete foundation 20, and in some cases the trench may define at least a portion of a concrete wall. The method may include the preliminary step of framing the wall by creating concrete form 10, 10', as in step 62, or adding reinforcing material such as wall rebar 24 and spacers 26 to reinforce the resulting concrete wall as in step 62. The method may include adding wire gages in the concrete form 10 to allow monitoring of thickness of the concrete wall or the depth of the concrete inside the concrete form 10.

The step 54 of applying the decorative coating 36 method may include one or more of the steps of applying the decorative coating by a pneumatic device or other device imparting sufficient velocity to the decorative material 36 to embed it into the plastic concrete surface 32, 34, preferably to the depths describe herein; or applying the decorative material 36 by hand as by broadcasting color or floating/troweling the material 36 into the plastic concrete surface.

The step 58 of exposing the decorative materials 36 may include applying a surface retarder and later washing the retarder to remove cement entraining the particles in the decorative materials to further expose those particles. The step 58 may also include exposing particles in the decorative materials 36 by acid etching, or chemical etching, or sandblasting, or high pressure spray, or grinding and/or honing, or water sponging.

Referring to FIGS. 6-10, an alternative method of forming the decorative surface on a concrete wall is disclosed. The concrete form 10 and foundation or bottom panel 20 and wall rebar 24 and brace 22 are as previously described. But a front panel 42 is provided and is typically fastened to the end panels 14, 16 to create a modified concrete form 10' that further defines wall cavity 18' to include the space between the front and back panels 42, 12, as well as the end panels 14, 16 and foundation or bottom panel 20. A second brace 44 is optionally fastened as needed to the end panels 14, 26 and/or front panel 42 to maintain the desired shape of the front panel when the weight of the concrete between the front and back panels 42, 12 urges those panels apart or bows those panels. The front and back panels 42, 12 may be connected intermediate the end panels 14, 16 by various ties to maintain the spacing between panels 12, 42 under the weight of wet concrete. The main difference with modified form 10' is that it encloses all but the top of the wall cavity 18' which will shape the concrete wall when filled with concrete.

The front and back panels 42, 12 are typically each planar and parallel to one another to define a wall of a uniform thickness defined by the space between the forms. But the front and back panels 42, 12 need not be planar or parallel as the shapes and relative inclination and/or orientation of the panels may be altered to vary the thickness of the concrete wall and the shape of the concrete wall. For example, the panels 12, 42 may have convex or concave portions that are conforming and parallel, or opposing and diverging. The same applies to the end panels 14, 16. The modified form 10' and front and back panels 42, 12 may be inclined to the horizontal but is usually vertical, with the braces 22, 44 supporting the parts of the modified form 10 to which they are attached.

Wall rebar 24 is placed in the wall cavity 18' as described. In addition to the rebar 24, the wall cavity 18' may contain other items, including wire gages, electrical conduits, plumbing fittings, pass through fittings and other items to be entrained in the concrete wall. Wet, non-hydrated concrete mixture 30' is poured into the wall cavity 18' to entrain the rebar and other items in the cavity 18'. The concrete mixture 30' preferably includes a combination of small and large aggregate and may include any concrete mixture believed suitable for the particular needs of the concrete wall being constructed, and may include the sprayed concrete mixtures and gunite described above. This concrete mixture 30' may form part of an exposed surface of the finished concrete wall. The concrete mixture 30' is poured or otherwise placed into the wall cavity 18' until the wall cavity 18' is filled sufficiently to form a concrete wall of the desired dimensions.

The concrete mixture 30' is preferably vibrated to remove air bubbles and consolidate the concrete mixture and the top edge of the concrete wall is finished to whatever texture is deemed appropriate, usually by floating the top edge to a flat, horizontal shape. The concrete mixture is allowed to partially hydrate until such time that the front panel 42 can be removed without the concrete wall slumping at the bottom panel 20 and while the exposed concrete wall surface 46 that was adjoining the front panel 42 is still plastic. As used herein, slumping of a poured concrete wall formed between front and back panels 12, 42 occurs when the thickness of the concrete wall at the bottom panel 20 increases by 5% or more after the first of the front or back panels 12, 42 is removed.

Figure 8:
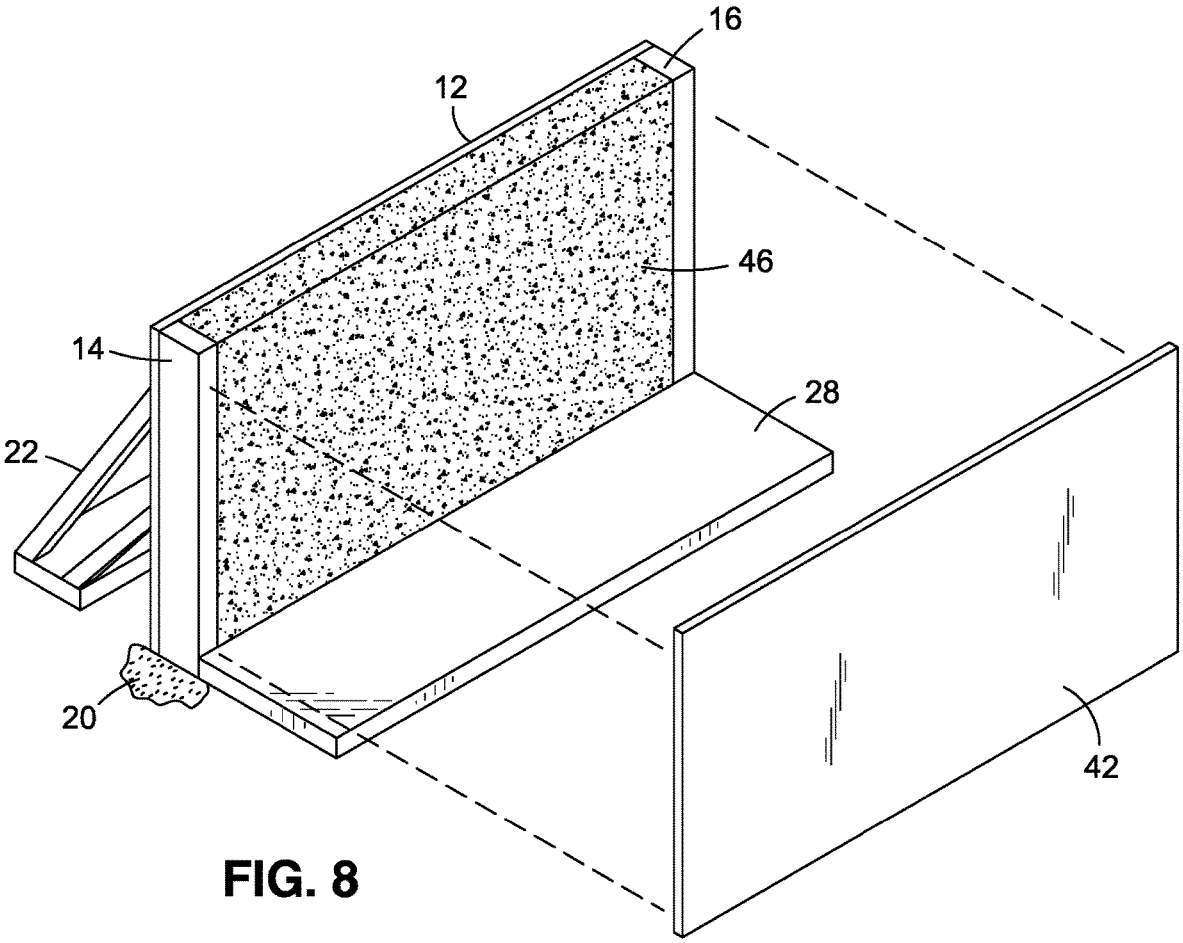
FIG. 8 is a perspective view of the concrete form of FIGS. 6-7 with one side panel removed.
Figure 9:
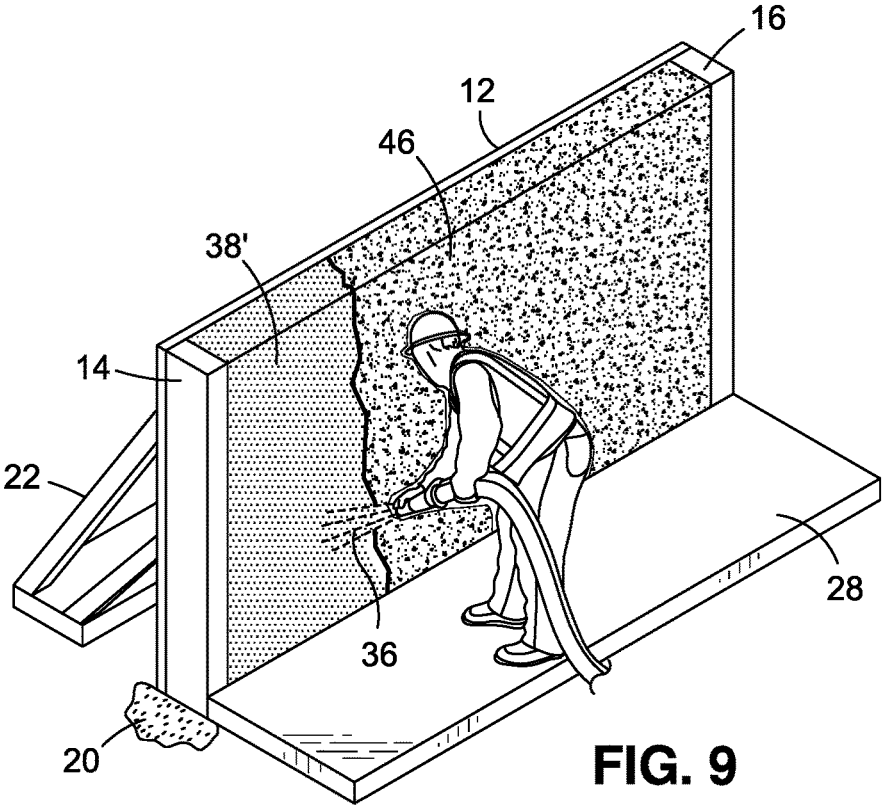
FIG. 9 is a perspective view of a worker applying a decorative material to the concrete in the wall form of FIG. 8 by projecting the decorative material into the exposed, plastic exterior surface of the concrete wall after a side panel is removed to expose that plastic surface.
Figure 10:
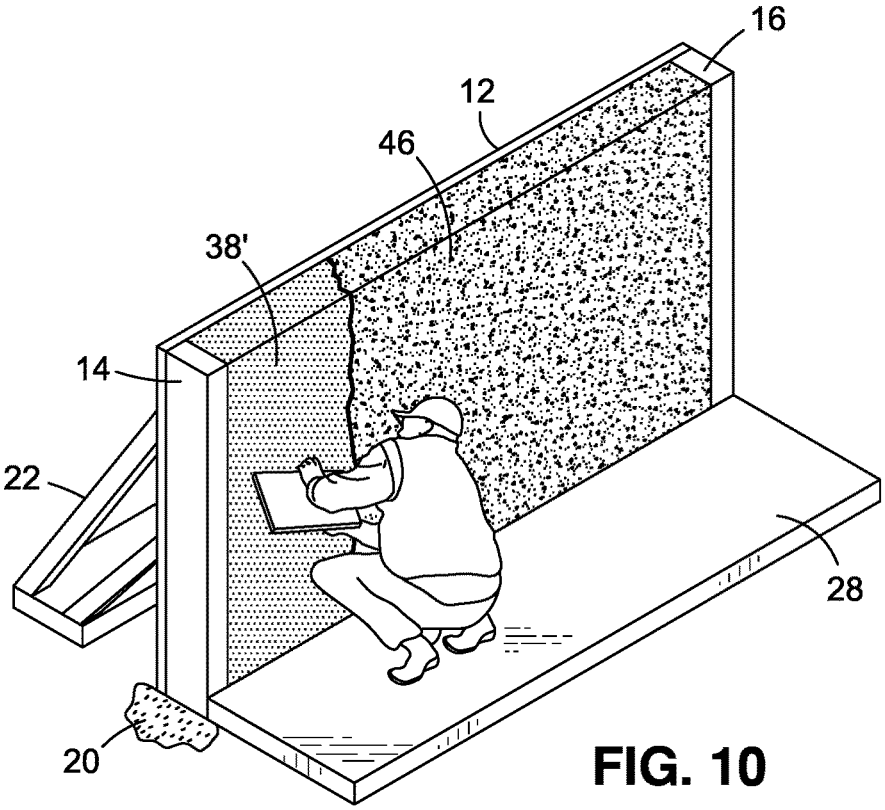
FIG. 10 is a perspective view of a worker floating the exposed exterior surface of the concrete wall.

As shown in FIGS. 8 and 9, the front panel 42 is removed at a time such that the concrete is hydrated sufficiently to stand and not slump at the bottom panel 20 or along a height of the wall. The front panel 42 is removed to expose the plastic surface 46 and the decorative material 36 is then applied (FIG. 9) as described herein to the exposed plastic concrete wall surface 46. Depending on the roughness and desired treatment of the exposed plastic concrete wall surface 46 after the front panel 42 is removed, the wall surface 42 may optionally be floated, typically using a bull float or trowel to further smooth the plastic surface of the concrete wall, before the decorative material 36 is applied. Referring to FIG. 9, the decorative material 36 may be applied to the wall surface 46 without floating the exposed concrete wall surface 46, or applied after such floating. The decorative material 36 is applied as described above, for example by pneumatic pressure through hose 31, or broadcast by hand, or applied to the float 40 (See FIGS. 3, 10) which then applies the material to the wall surface 46. The decorative material 36 may optionally be applied to the top edge of the wall as well as to the exposed wall surface 46. Because the top edge is typically uncovered as the concrete wall cures and hydrates, the decorative material 36 may be applied at any time after the concrete mixture 30 is poured and the top edge is formed.

In some situations the decorative material 36 embedded in the exposed concrete surface 46 may be floated (FIG. 10) to further embed the decorative material into the plastic concrete surface and to create the desired surface texture or finish or configuration. The steps for applying the decorative material 36 are as described above and elsewhere herein. While the description of those steps in detail is not repeated, the steps result in a finished decorative surface 38'.

The finished decorative concrete wall surface 38' may comprise the concrete wall with the decorative material 36 applied to the concrete surface 46 by any of the described steps without further finishing steps. Advantageously though, the finished concrete wall surface 38' is further floated to further embed the decorative material 36 in the concrete wall and is further finished by surface troweling to draw the cement toward the exposed surface while further embedding the decorative material 36 in the wall.

Advantageously, when the front panel 42 is removed, the remaining portions of concrete form 10' are left in place to protect the concrete wall from marring and damage and to further support the wall so it does not slump at the bottom panel 20 or is otherwise marred while the surface is in the plastic state. After the concrete wall is more fully hydrated to its rock-like hardness, the remaining removable portions of concrete form 10 are removed, at least by one day after pouring the wall.

Referring to FIGS. 6-12 and especially to FIG. 11, the method of forming the decorative concrete wall may include the step 68 of framing and/or pouring a foundation 20 that creates a bottom panel for the concrete wall. Typically, foundation rebar 25 is embedded in the foundation 10 and extends upward so as to be entrained in the resulting concrete wall that is typically poured later (e.g., FIGS. 1-2, 12A-12B). Method step 69 of assembling the concrete form 10' which form is configured to create a wall of desired dimensions, and where the form has at least a front panel 42 that is preferably configured to be removed while the remaining portions of the concrete form 10' remain, and where optionally one or more of the back panel 12 and end panels 14, 16 may be removed. Step 70 includes pouring wet concrete into the concrete form 10' to fill the wall cavity 18' and create a body of wet, un-hydrated concrete conforming the shape of wall cavity 18'.

Method step 72 includes stripping at least one of the panels of the concrete form 10', preferably stripping the front panel 42 from the concrete form to expose the plastic concrete surface 46 previously adjoining that front panel 42 (or panels 12, 14, 16) while that exposed concrete surface is still plastic but will not slump. Step 73 is optional and includes floating the recently exposed, plastic concrete surface 46. Step 74 applies the decorative material 36 to the exposed concrete surface 46 (optionally including applying the material 36 to the surface previously adjoining panels 12, 14, 16) while that concrete surface is still plastic and to any other visible portions of the concrete wall to which the coating is desired to be applied. Optional step 76 floats the exposed concrete surface 46 and decorative material 36 to further embed the material 36 into the plastic surface of the concrete wall (including surfaces adjoining panels 12, 14, 16 or the top edge of the wall) and to bring cement from the wall to the surface 46. Optional step 78 further exposes the decorative materials 76 using processes described herein to further expose the decorative materials 36 to enhance the aesthetic appearance of these materials 36, especially the particulate materials.

In FIG. 6-10, only one panel (front panel 42) was removed to expose the underlying plastic concrete surface 46. Removing only the front panel 42 while leaving the remainder of the poured concrete wall encased in the remainder of the concrete form 10' allows the form 10' to provide support to the concrete wall and helps avoid slumping, surface marring or other undesirable deformations on the faces of the wall adjoining the respective concrete forms. The internal wall rebar 24 and any foundation rebar 25 extending into and entrained within the wall also helps maintain the wall in the desired configuration. It is believed possible to remove both the side panels 12, 42 (and associated braces 22, 44) while leaving the end panels 14, 16.

It is believed possible to apply the decorative surface material 36 to both exposed plastic side surfaces of the concrete wall using the above described steps of FIG. 11 for exposed surface 46 and for the exposed surfaces adjoining panels 12, 14, 16 while the underlying concrete surface is still sufficiently pliable. Because the concrete continues to hydrate and harden with time, applying the decorative material 36 is done while the exposed concrete surface 46 is still pliable enough to accept the decorative material when applied as described herein, without causing cracking, spalling or chipping of the exposed concrete surface to which the decorative material is applied. It is believed possible to remove one or more of the panels 12, 14, 16 and 42, apply surface retarder to the adjoining concrete surface(s) and then replace the removed panel to extend the time during which the adjoining concrete surface is plastic in order to allow more time to work on the surface while allowing the bulk of the wall to harden and become self-supporting and reducing potential slumping.

Depending on the internal support to the concrete wall from wall rebar 24 and internal strengthening parts, and the concrete mixture and wall design, it is further believed possible to remove one or both of the end panels 14, 16 to expose end surfaces of the concrete wall and to then apply the decorative material 36 to one or both of the exposed end surfaces of the concrete wall. Thus, it is believed that all exposed faces of the concrete wall could have decorative material applied to those exposed surfaces.

The process for applying the decorative material 36 is described above and not repeated here. Depending on the concrete mixture and environmental conditions, it may be desirable to leave one or more of the end panels 14, 16 or the back panel 12 in place while the front panel 42 is removed in order to reduce hydration of the concrete surfaces adjoining those panels and thus extend the time when those underlying surfaces are sufficiently plastic to receive the decorative material 36 or to be floated to further embed the decorative material 36 into the concrete surfaces.

Multiple workers may simultaneously apply decorative material 36 to one or more surfaces previously underlying panels 12, 14, 16 or 44, or the panels may be removed at different times or in different combinations and decorative material applied sequentially or at different times to those different combinations of the underlying surfaces beneath the panels as the panels are removed.

The method embodied in FIGS. 5-11 may include the preliminary step 68 (FIG. 11) of framing and/or pouring a foundation or bottom panel 20 and may further include the preliminary step of assembling the wall frame 10' and installing reinforcing such as wall rebar 24 and spacers 26 and other components to be entrained within the wall. The step FIG. 11 74 of applying decorative materials 36 may include applying the materials using a pneumatic device to project the materials into the plastic surface of the concrete wall, or it may include applying the decorative materials by hand as by broadcasting them against the plastic surface or troweling them into the plastic surface or applying a liquid containing the decorative material with a brush or roller.

The FIG. 11 step 78 of exposing the decorative materials 36 may include applying a surface retarder and later washing the retarder to remove cement entraining the particles in the decorative materials to further expose those particles. The step 78 may include further exposing particles in the decorative materials 36 by acid etching, or chemical etching, or sandblasting, or high pressure spray, or grinding and/or honing, or water sponging.

The methods reflected in FIGS. 1-12 and described with respect to FIG. 11 may further include the optional step 80 of applying a sealant to the decorative surface 38, 38', including applying a sealant to the further exposed decorative materials. The sealant is applied when the decorative surface 38, 38' is created and ready to receive the sealant, so the timing and sequence of step 80 may vary. The sealant is typically a clear polymer selected to allow and/or enhance visibility and appearance of the decorative materials 36 and usually to also help avoid the decorative materials 36 from being removed from the concrete wall in which they materials are at least partially entrained. The application of the sealant may be preceded by an acid wash, with the acid wash preferably after the concrete is no longer plastic enough to apply the decorative material as embedded particulates, although the acid wash could be part of an step to enhance the appearance of the decorative material.

Figure 12A:
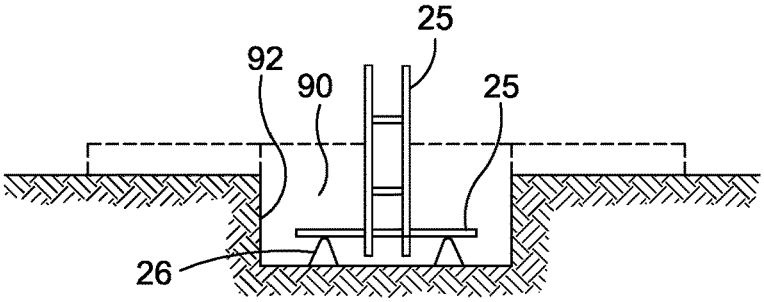
FIG. 12A is a sectional view of a concrete trench or form for pouring a concrete foundation with a hand floated top surface.
Figure 12B:
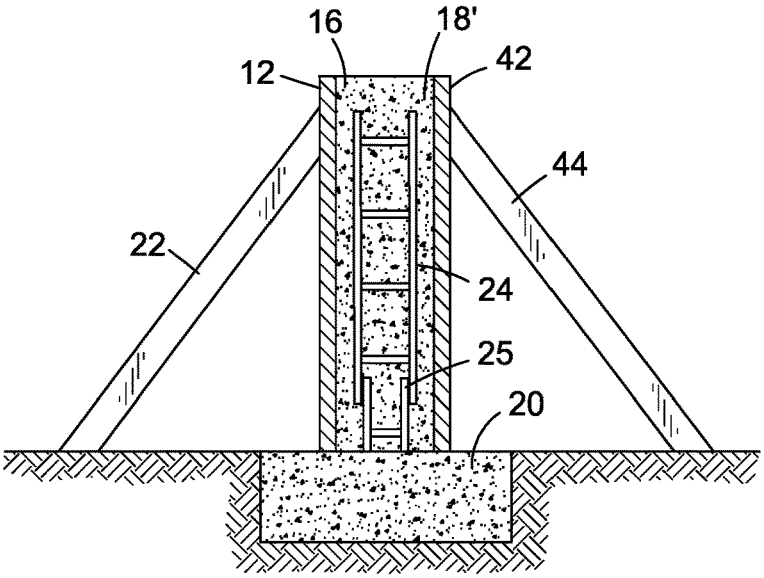
FIG. 12B shows a sectional view of a vertical, poured concrete wall form on the foundation of FIG. 12A with the concrete form filled with concrete.

Referring to FIGS. 12A-12B, the foundation 20 is typically created by digging a trench 90 so the dimensions of the trench form a trench cavity 92 to define the size of the foundation. The end of the trench may also be formed by the ground, or alternatively one or more end panels 14, 16 may be placed in the trench to define the length of the foundation and the length of the trench cavity. The end panels are usually held in place by stakes driven into the ground. Front and back panels 12, 42 may also be used to define the long sides of the cavity for the foundation 20. Foundation rebar 25 (which includes any other strengthening components or members) is placed in the trench 90 (or floor or foundation forms) and held apart from the trench walls and bottom of the trench by spacers 26. Typically, foundation rebar 25 extends upward out of the foundation to interconnect with the wall rebar 24 used to form the wall and/or to interconnect with the concrete forming the wall. Sometimes the foundation 20 comprises a concrete floor, in which case the floor has foundation rebar 25 placed along the length of the wall and sized to extend above the finished surface of the floor.

The trench cavity 92 (or forms defining the sides of the floor or foundation) is then filled with concrete mixture 30 with the top surface being floated to the desired configuration, which is usually a flat, horizontal surface. If the foundation is a floor, the concrete surface is usually machine troweled and that troweling may extend close to but does not contact the foundation rebar 25 extending out of the surface of foundation or bottom panel 20. Typically, the foundation 20 is poured separately from the concrete wall and before the wall forms 10, 10' are put in place. After the concrete in the trench cavity 92 (or floor) hardens to form the foundation 20 of the desired shape, any foundation forms (or other forms) are removed and any empty spaces between the trench and foundation 20 may be filled with earth or other materials, or left until the concrete wall is formed before being filled.

Referring to FIG. 12B, the concrete form 10 or 10' is then assembled on the foundation 20 and adjacent ground (or floor), with foundation rebar 25 placed within the cavity 18, 18' as required by the particular strength needed for the concrete wall. The wall rebar 24 for the concrete wall may optionally be fastened to any foundation rebar 25 extending from the foundation 20 (or floor) by wires even welding or by placing the bottom end of a continuous strip of wall rebar into the foundation 20 before the foundation is formed so it is entrained in both the foundation and wall whether or not those parts are formed simultaneously. The concrete wall is then constructed as described above regarding FIGS. 1-10.

Figure 12C:
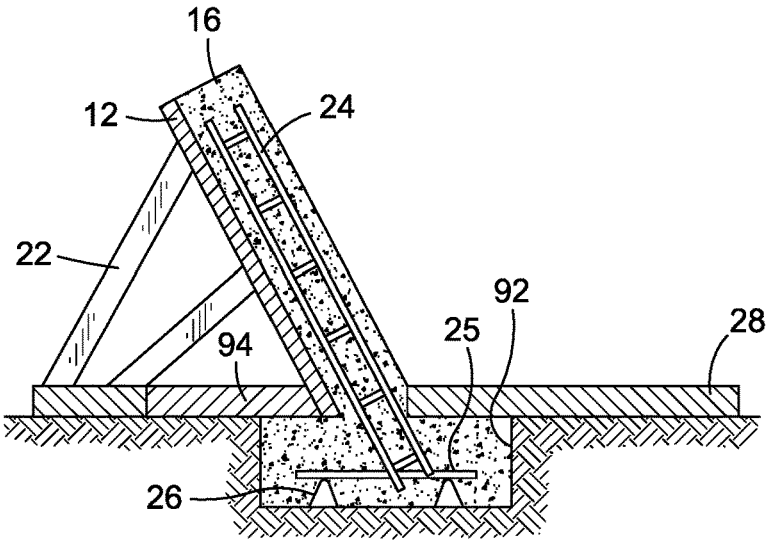
FIG. 12C is a sectional view of an inclined poured concrete wall form and foundation form, both filled with concrete.

Referring to FIG. 12C, the foundation 20 may be formed concurrently with the concrete wall. The trench cavity 92 is created by digging a shaped trench in the ground or by placing foundation forms in the trench to shape the foundation or bottom panel 20. The various wall panels 12, 14, 16, 21 and 42 are put in place to define the wall cavity 18, 18', depending on the shape of the concrete wall and the process used to form the wall. Foundation rebar 25, wall rebar 24, spacers, wire gages and any other components to be entrained in the concrete are then placed in the cavities 18, 18' and 92. The foundation rebar 25 may extend from the foundation's trench cavity 92 into the wall cavity 18, 18'. The concrete mixture 30 is then projected into both the foundation trench cavity 92 and wall cavity 18, or the concrete mixture is poured into both the foundation trench cavity 92 and the wall cavity 18'. After the formation of the concrete wall is completed and the concrete is sufficiently hardened, any remaining concrete forms 10, 10' are removed.

Because the weight of the concrete in the wall cavity 18, 18' may affect the shape of the foundation's top surface while the concrete is wet and before the concrete foundation hydrates and hardens sufficiently to support the weight of the wall, top foundation panel 94 may be provided to form the top side of the foundation 20, and the protective floor panel 28 may be used as a top foundation panel on a side of the foundation opposite panel 94. The top foundation panel 94 and panel 28 may be used with the foundation formation process of FIGS. 12A, 12B and the panels 28, 94 may be considered as part of the concrete forms 10, 10'. The concrete mixture 30 may have to be vibrated or specially projected to ensure it fills the cavity 92 below the top foundation panel 94 and panel 28.

The present methods offer advantages reflected in the resulting concrete wall. By applying the decorative material 36 while the wall is still in a plastic state, the decorative material may be applied without polymers or bonders and without the need to entrain the decorative material in a second, different mixture of concrete and then applying that second mixture to the wall. That avoids the cost and cleanup and environmental issues associated with such polymers and bonders. The ability to apply the decorative material to the plastic wall surface and to embed the decorative material 36 into the concrete surface or wick the decorative material into the plastic concrete surface is believed to provide several additional advantages. The process allows a much simpler application process which reduces labor costs. It allows a much faster process because it can be completed the same day the concrete wall is poured or s hot, and is completed before the concrete hydrates to its rock-like hardness. It requires less cleanup as there is no second cement or concrete coating or bonding agent applied. It avoids the need to roughened a hardened concrete surface to improve adhesion of decorative materials. It avoids the need to repeatedly return to the job site. It avoids the need for a costly finishing layer and avoids the need to segregate aggregates by size as in U.S. Pat. No. 8,962,088. It allows a wide variety of materials to be applied as the decorative material 36. It also provides secure entrainment of the decorative material in the concrete surface using the concrete itself, and thus avoids the degradation which can arise from prolonged exposure to sunlight of some bonding agents.

The process of forming a decorative wall described herein also produces a wall having new and improved properties. Because the decorative material 36 is applied to the concrete wall while it is still plastic, the bonding of the material to the wall is improved and the decorative surface 38, 38' are believed to be less subject to cracking, chipping and spalling than decorative surfaces on prior art walls.

If the foundation or bottom panel 20 is poured or formed at the same time as the concrete wall, then the wall rebar 24 and foundation rebar 25 will extend between the bottom panel 20 and the concrete wall and be entrained in the concrete mixture 30, 30' as the bottom panel and wall can be simultaneously formed, resulting in a superior structural connection. Typically, the foundation or bottom panel 20 comprises a concrete foundation that is poured and allowed cure before the concrete forms 10, 10' for the wall are created are created with the foundation rebar 25 connected to the wall rebar 24 by wires or welding, or interconnected by the concrete mixture 30 forming the concrete wall that is poured after the foundation cures. Advantageously, the foundation 20 is poured and hydrates for at least a day before the concrete wall is poured into concrete forms 10' or projected into concrete forms 10. Either foundation or bottom panel 10 provides a strong base for the resulting concrete wall with the decorative material 36. Alternatively, the rebar 24 may be places so its bottom portion is located in the foundation cavity and the rebar 24 extends continuously along the length and height of the wall form 10' (and 10) as in FIGS. 1-2.

Further, the plastic concrete surface 32, 34, 46 is preferably vertical or generally vertical when the decorative material 36 is applied and the resulting finished decorative surface 38, 38' will have a final appearance that can be readily determined. For example, tiles cast horizontally and viewed in a horizontal orientation in a store or warehouse may appear different when applied to a vertical wall, and even vertically displayed tiles present a different appearance when presented in isolation compared to the appearance created by multiple tiles assembled together. As long as the exposed surfaces 32, 46 are sufficiently plastic the decorative material 36 may be further manipulated to adjust the appearance, as for example by further floating, applying more decorative material 36, or applying surface treatments—especially those suitable for use with plastic concrete.

Additionally, the application of the decorative material 36 to a vertical or off-vertical wall is believed to cause a different appearance and a different interlock with the plastic concrete surface 32, 46 than arises if the decorative material were applied to a horizontal surface. As used herein, the generally vertical orientation refers to angles of inclination of up to 30° from the vertical, and substantially vertical includes inclined angles of 5° or less from the vertical. But the method described herein is believed usable with walls inclined at angles of up to 80° from the vertical, although the inclined angle is advantageously 60° to 45° from the vertical and is preferably less 5° inclined from the vertical. If the decorative material 36 is broadcast by hand or machine, the angle of inclination of the wall (and of the forms 10, 10') affects how gravity disperses the decorative material 36 and how that material initially penetrates the exposed surfaces 32, 46.

If the decorative material 36 is projected into the exposed concrete surface 32, 46 the relative angle of inclination between the trajectory of the decorative material and the exposed concrete surfaces affects the depth and orientation of the decorative particles as they are embedded into the exposed concrete surfaces. If the decorative material 36 is applied by floats, or floated after application, gravity will affect how the material is embedded into and interlocked with the exposed concrete surface 32, 46. If the decorative material 36 is applied by brushes or rollers, gravity affects how the decorative material will flow down and penetrate the exposed surface 32, 46 and how air-born contaminants affect that exposed surface and the applied decorative materials. The resulting finished decorative surface 38, 38' lacks the distinctive layered construction that results from the prior art processes that apply first and second concrete mixtures with different sizes of aggregate in the concrete mixes as is done in U.S. Pat. No. 8,962,088, and avoids the issues that arise from the attempts to interlock two separately applied layers of concrete mix.

The vertical or off-vertical orientation of the exposed concrete surfaces also affects how surface treatments affect the decorative material 36 as the orientation of the wall affects how the surface treatments are applied, especially as a vertical or inclined wall will cause liquid surface treatments flow downward compared to a horizontal orientation which would puddle the liquids at low spots. Also, applying the decorative materials in the as-used, vertical or off-vertical orientation is believed to result in a finished decorative surface 38, 38' with a different residual stress adjacent the surface of the concrete wall (i.e., within 0.5 inches) compared to the decorative surfaces that would result if they were prepared using a horizontal form 10, 10', or if the decorative surface is applied as a separate layer of concrete mixture to a vertical wall as in U.S. Pat. No. 8,962,088. Embedding the decorative material into a plastic concrete surface 32, 46 is believed to be very different than entraining the material in a concrete mixture and applying the mixture as a separate layer. Thus, the resulting concrete wall with a finished decorative surface 38, 38' is believed to have new and different properties and characteristics compared to the prior art.

The complete contents of all patents and patent applications identified herein are incorporated by reference.

The detailed description set forth above in connection with the drawings is intended as a description of some, but not all, of contemplated embodiments of the disclosure, and is not intended to represent the only form in which the present disclosure may be constructed or utilized. The description sets forth the functions and the sequence of steps for developing and operating the disclosure in connection with the illustrated embodiments.

It is to be understood, however, that the same or equivalent functions and sequences may be accomplished by different embodiments that are also intended to be encompassed within the spirit and scope of the disclosure. It is further understood that the use of relational terms such as first and second, top and bottom, and the like are used solely to distinguish one entity from another entity without necessarily requiring or implying any actual such relationship or order between such entities.

The particulars shown herein are by way of example and for purposes of illustrative discussion of the embodiments of the present disclosure only and are presented in the cause of providing what is believed to be the most useful and readily understood description of the principles and conceptual aspects of the present disclosure. In this regard, no attempt is made to show structural details of the present disclosure in more detail than is necessary for the fundamental understanding of the present disclosure, the description taken with the drawings making apparent to those skilled in the art how the several forms of the present disclosure may be embodied in practice.

What is claimed is:

1. A method of forming a concrete wall in a concrete form having two opposing end panels, a bottom panel and a back panel extending between the end panels to define a wall cavity, the wall cavity containing wall rebar; the method comprising:

projecting a concrete mixture into the wall cavity sufficient to create a concrete wall entraining the wall rebar, the concrete wall having two opposing ends each adjoining a different one of the end panels, a back surface adjoining the back panel and an exposed front wall surface opposite the back panel;

floating, cutting or both floating and cutting the exposed front wall surface to achieve at least one of a desired wall thickness or wall contour;

applying a decorative material to the exposed front wall surface while that front wall surface is plastic, the decorative material comprising a colored liquid having no discrete physical particles detectible by rubbing the liquid between a person's fingers, the liquid penetrating the exposed front wall surface to a depth of at least 0.1 inches;

troweling the front wall surface;

applying a surface treatment to the decorative material;

applying an acid cleaner to the decorative material; and applying a sealant to the decorative material.

2. The method of claim 1, wherein the bottom panel comprises a concrete foundation and further comprising a preliminary step of placing foundation rebar in a foundation cavity, with the foundation rebar extending into the wall cavity; and wherein the step of projecting a concrete mixture further includes projecting the concrete mixture into the foundation cavity to create the foundation and wall at the same time.

3. The method of claim 1, wherein the bottom panel comprises a concrete foundation and further comprising a preliminary step of creating the foundation and allowing it to hydrate for at least one day before applying the concrete mixture to the wall cavity.

4. The method of claim 1, wherein the bottom panel comprises a concrete foundation and further comprising a preliminary step of creating the foundation and allowing it to hydrate for at least one day before applying the concrete mixture to the wall cavity.

5. The method of claim 1, wherein the concrete wall is substantially vertical.

6. The method of claim 1, wherein the decorative materials are applied by hand.

7. The method of claim 1, wherein the decorative materials are applied by projecting the decorative materials against the front surface of the concrete wall with sufficient force to embed the decorative materials into that front surface.

8. A method of forming a concrete wall in a concrete form having two opposing end panels, a bottom panel and a back panel extending between the end panels to define a wall cavity, the wall cavity containing wall rebar; the method comprising:

projecting a concrete mixture into the wall cavity sufficient to create a concrete wall entraining the wall rebar, the concrete wall having two opposing ends each adjoining a different one of the end panels, a back surface adjoining the back panel and an exposed front wall surface opposite the back panel;

floating, cutting or both floating and cutting the exposed front wall surface to achieve at least one of a desired wall thickness or wall contour;

applying a decorative material to the exposed front wall surface while that front wall surface is plastic, the decorative material comprising a colored liquid having no discrete physical particles detectible by rubbing the liquid between a person's fingers, the liquid penetrating the exposed front wall surface to a depth of at least 0.1 inches;

troweling the front wall surface; and applying a surface treatment to the decorative material;

wherein the step of applying the surface treatment comprises one of sandblasting, grinding or honing.

9. A method of forming a concrete wall in a concrete form having two opposing end panels, a bottom panel and a back panel extending between the end panels to define a wall cavity, the wall cavity containing wall rebar; the method comprising:

projecting a concrete mixture into the wall cavity sufficient to create a concrete wall entraining the wall rebar, the concrete wall having two opposing ends each adjoining a different one of the end panels, a back surface adjoining the back panel and an exposed front wall surface opposite the back panel;

floating, cutting or both floating and cutting the exposed front wall surface to achieve at least one of a desired wall thickness or wall contour;

applying a decorative material to the exposed front wall surface while that front wall surface is plastic, the decorative material comprising a colored liquid having no discrete physical particles detectible by rubbing the liquid between a person's fingers, the liquid penetrating the exposed front wall surface to a depth of at least 0.1 inches;

troweling the front wall surface; and applying a surface treatment to the decorative material;

wherein the step of applying the surface treatment comprises one of chemical etching, sponging or applying a retarder and later washing some of the retarder off.

* * * * *